US007913478B2

(12) United States Patent
Lavi

(10) Patent No.: US 7,913,478 B2
(45) Date of Patent: Mar. 29, 2011

(54) FOOD SERVICE SET ASSEMBLY SYSTEM AND METHOD

(75) Inventor: Payam Lavi, Oceanside, CA (US)

(73) Assignee: Convenience Enterprises, Inc., Beverly Hills, CA (US)

( * ) Notice: Subject to any disclaimer, the term of this patent is extended or adjusted under 35 U.S.C. 154(b) by 123 days.

(21) Appl. No.: 12/194,184

(22) Filed: Aug. 19, 2008

(65) Prior Publication Data

US 2008/0302066 A1 Dec. 11, 2008

Related U.S. Application Data

(63) Continuation-in-part of application No. 11/044,538, filed on Jan. 26, 2005, now Pat. No. 7,412,808.

(60) Provisional application No. 60/539,545, filed on Jan. 26, 2004, provisional application No. 60/581,735, filed on Jun. 22, 2004.

(51) Int. Cl.
*B65B 11/10* (2006.01)
*B65B 13/02* (2006.01)

(52) U.S. Cl. ..... 53/466; 53/228; 53/399; 53/586; 53/155

(58) Field of Classification Search ..... 53/137.2, 53/154, 155, 228, 238, 250, 399, 419, 425, 53/445, 461, 466, 582, 586
See application file for complete search history.

(56) References Cited

U.S. PATENT DOCUMENTS

| | | | | |
|---|---|---|---|---|
| 5,237,801 | A * | 8/1993 | Hillam et al. | 53/238 |
| 5,469,688 | A * | 11/1995 | Dunbar et al. | 53/461 |
| 6,023,908 | A * | 2/2000 | Vetsch | 53/155 |
| 6,023,913 | A * | 2/2000 | Gray et al. | 53/399 |
| 6,202,387 | B1 * | 3/2001 | Brown et al. | 53/137.2 |
| 6,615,566 | B2 * | 9/2003 | Heisey | 53/229 |
| 7,210,279 | B1 * | 5/2007 | Ahmed et al. | 53/155 |
| 7,322,172 | B2 * | 1/2008 | Hoffman et al. | 53/155 |
| 7,412,808 | B2 * | 8/2008 | Lavi | 53/228 |
| 2002/0112445 | A1 * | 8/2002 | Scaduto | 53/582 |
| 2004/0237475 | A1 * | 12/2004 | Rubin | 53/461 |
| 2005/0252057 | A1 * | 11/2005 | Lavi | 40/665 |

* cited by examiner

*Primary Examiner* — Louis K Huynh

(57) ABSTRACT

Food service set assembly systems and methods include delivery of one or more utensils and a napkin to a receiving cradle where they are grasped by two fingers attached to a rotatable shaft and wound to a desired tension. Utensils are delivered to the receiving cradle is a uniform alignment via a gravity driven system. Sterilization of the utensils can also be provided. Related systems, apparatus, methods, and/or articles are also described.

20 Claims, 12 Drawing Sheets

FOOD SERVICE SET ASSEMBLY SYSTEM AND METHOD

CROSS-REFERENCE TO RELATED APPLICATIONS

This application is a CIP of U.S. application Ser. No. 11/044,538, filed Jan. 26, 2005, now U.S. Pat. No. 7,412,808, which claims the benefit of U.S. Provisional Applications No. 60/539,545, filed Jan. 26, 2004 and No. 60/581,735, filed Jun. 22, 2004.

FIELD

The current subject matter relates generally to packaging one or more food utensils, and more particularly to an apparatus and method for assembling a service set having one or more utensils wrapped by a napkin.

BACKGROUND

Despite advances in automation, many processes within the food service industry are still largely manual. For example, preparing and providing a napkin and utensils for use by a customer is typically done manually. Some food service establishments, especially those that serve a large number of customers, attempt to conserve time by providing a "service set," that is, one or more utensils wrapped inside a napkin and secured by a piece of paper tape. The service pack can then be given to a customer so that setting utensils and the napkin at a table is unnecessary. Unfortunately, large amounts of manual labor time are still consumed in the formation of these service packs.

For each service set, a human must still select and bundle one or more utensils must still be manually bundled, wrapped in a napkin and then sometimes taped in place. At large food service establishments, such as with large chain restaurants, hotels, casinos, resorts, etc., the labor costs involved in forming and providing a large number of service sets can be substantial, particularly when all costs such as wages or other compensation and benefits are taken into account. Further, human contact with the various components of a service pack during the assembly process can lead to contamination and the transmission of disease.

SUMMARY

An apparatus and method for assembling a service set are disclosed, for saving time and energy that would normally be required of a person to manually assemble such a service set. The apparatus and method for assembling a service set also achieve a high throughput for outputting assembled service sets. Further, human contact with the various components of a service set is minimized by the disclosed apparatus and method, minimizing the risk of contamination and transmission of disease.

A device for assembling a service pack is disclosed. A service pack includes a napkin and a utensil set. The device includes a folding stage, and a vacuum chuck configured to lift a napkin from a stack of napkins, and place the napkin onto the folding stage. The device further includes a grabber that moves to a utensil assembly holding a number of utensils, the grabber configured to pick up a utensil set from the number of utensils, and place the utensil set onto the napkin. The device further includes a sterilization mechanism, configured to sterilize the utensil set.

In a further aspect, a system includes a utensil cartridge adapted to hold a plurality of one type of utensil, a release mechanism that releases one utensil at a time from the utensil cartridge, and a utensil guide having an inlet end and an outlet end. The inlet end is associated with and disposed below the release mechanism to receive the released utensil from the utensil cartridge. The utensil guide is disposed at a downward angle such that gravity causes the released utensil to travel from the inlet end to the outlet end. The released utensil entering the utensil guide in a specific and predetermined orientation which can optionally be with the head of the utensil leading the utensil down the utensil guide or with the handle of the utensil leading the utensil down the utensil guide. The system also includes a receiving cradle aligned at a downward angle between an entry end and an exit end. The entry end is disposed at a higher point than the exit and is positioned to receive the released utensil from the outlet end of the utensil guide onto a upward facing concave inner surface of the receiving cradle. The inner surface can optionally be substantially symmetrical about a central vertical plane passing between the outlet end and the inlet end. A napkin handler moves a napkin from a napkin supply point to the receiving cradle prior to delivery of the utensil from the utensil guide. The napkin is placed diagonally on the receiving cradle with one corner near the exit end. A wrapping guide having a concave down facing channel can be lowered onto the receiving cradle such a utensil set comprising the napkin and the released utensil is encircled by the concave down facing channel of the wrapping guide and the upward facing concave inner surface of the receiving cradle. A rotating mechanism includes a first finger and a second finger that originate from a common pivot point positioned on a rotating shaft having an axis of rotation. The first finger is movable about the pivot point, the second finger is fixed at the pivot point to remain substantially aligned with the axis of rotation. The first movable finger lifts the one corner of the napkin to provide a stop against which the released utensil comes to rest in a uniform alignment. The first movable finger folds the one corner down over the utensil and causes the utensil and the folded one corner of the napkin to be grasped as a utensil set between the first movable finger and the second fixed finger. The shaft rotates about its axis and causes the napkin to wrap about the grasped utensil set to a desired tension while the wrapping guide steadies the utensil set in the receiving cradle. An adhesive band dispenser dispenses an adhesive band dispenser that is secured about a finished utensil set.

In an interrelated aspect, a method includes placing a napkin diagonally on an inner surface of a receiving cradle. The receiving cradle has an exit end and an entry end, and the he napkin is placed such that one corner of the napkin is adjacent the exit end. The inner surface has an upward facing concave shape. The method further includes delivering one or more utensils to the inner surface of the receiving cradle via one or more utensil guides. Each of the one or more utensil guides conveys one type of utensil from a utensil cartridge that holds a plurality of that one type of utensil in an ordered manner such that each released utensil is released onto the utensil guide in a uniform alignment and then delivered to the receiving cradle with the same uniform alignment. A first movable finger attached to a rotating shaft lifts the one corner of the napkin. The rotating shaft also includes a second fixed finger that extends under the corner of the napkin. The first movable finger and the lifted one corner of the napkin provide a stop against which the delivered one or more utensils come to rest in the uniform alignment. The uniform alignment can optionally include a head of all of the utensils being positioned closest to the exit end of the receiving cradle and against the one corner of the napkin and the first movable finger. Alternatively, the uniform alignment can optionally include a handle of all of the utensils being positioned closest to the exit end of the receiving cradle. The one corner of the napkin is folded down over the one or more utensils by lowering the first movable finger. The lowering of the first movable finger causes the one or more utensils and the folded one corner of the napkin to be grasped as a utensil set between the first movable finger and the second fixed finger. A wrapping guide having a concave down facing channel is lowered onto the receiving cradle such that the utensil set is encircled by the concave down facing channel of the wrapping guide and the concave up inner surface of the receiving cradle. The shaft is rotated along with the grasped utensil set to cause the napkin to be wrapped about the one or more utensils to a desired tension.

The details of one or more embodiments are set forth in the accompanying drawings and the description below. Other features, objects, and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes apparatuses and methods for assembling a service set, in which many previously manually-performed tasks are automated and performed to a high degree of precision. Further, these apparatuses and methods reduce potential contamination of any of the components of a service set to provide a service set that is free of germs and/or disease-causing agents.

Figure 1:
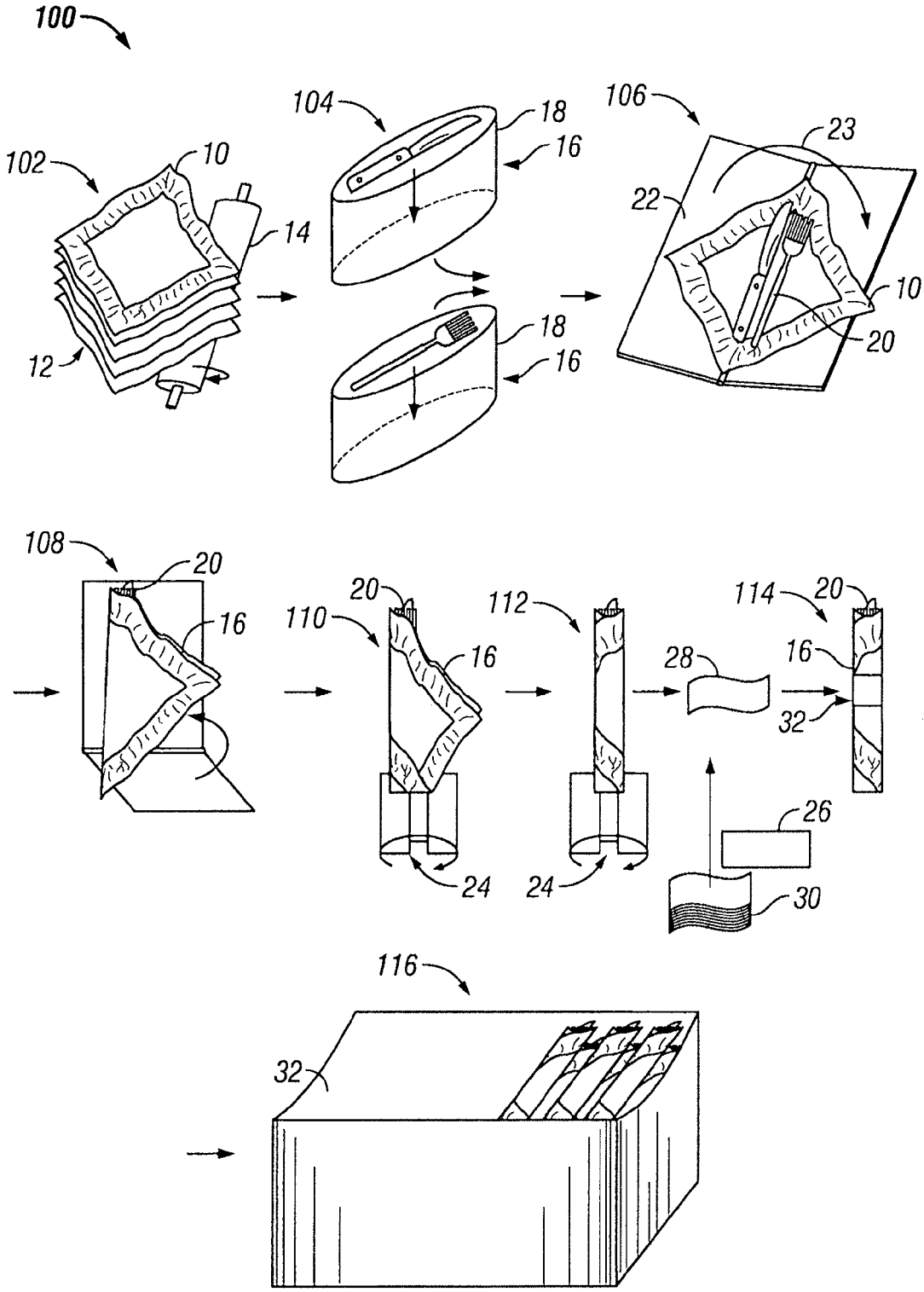
FIG. 1 graphically depicts a process for assembling a service set.

FIG. 1 graphically depicts a general process 100 for mechanically assembling a service set in accordance with one embodiment. At 102, a napkin 10 from a napkin stack 12 is provided to a napkin feeder 14, which feeds the napkin 10 to a receiving position at 106. At 104, one or more utensils 16 are provided to individual utensil feeders 18, which feeds the one or more utensils to the napkin 10 in the receiving position 106. The one or more utensils 16 may include a knife, a fork, a spoon, or some combination thereof. Each utensil feeder 18 may include a cartridge or other detachable holding mechanism that can be attached to a mechanism for holding and feeding the one or more utensils 16 one at a time to the napkin 10. In an alternative embodiment, a combination of utensils 16 may be provided to a single utensil feeder 18. The one or more utensils 16 provided to the napkin 10 in the receiving position 106 form a utensil set 20.

After the utensil set 20 has been fed to the napkin 16 in the receiving position 106, a folding mechanism 22 folds the napkin 16 around the utensil set 20, also shown at 108, to a folded position 110. The folding mechanism 22 can include a first folder for folding the napkin along a first axis 23 shown at 106, and a second folder for folding the napkin along a second axis 25, shown at 108, where the second axis 25 can be substantially normal to the first axis 23. Any sized portion of the napkin 16 can be part of the folding of the first or second folder. For example, as shown in FIG. 1, the first folder can fold the napkin 16 substantially in half, while the second folder may fold only a small lower portion of the napkin back on itself. The folding mechanism 22 may also be configured to perform all folds of the napkin 16 in one integrated step.

In the folded position the napkin 16 and utensil set 20 therein are provided to a rolling mechanism 24, at 110 and 112. The rolling mechanism 24 can include a first roller for rolling the napkin 16 and utensil set 20 in a first, i.e. clockwise, direction, and a second roller for rolling the napkin 16 and utensil set 20 in a second, i.e. counter-clockwise direction. The rolling mechanism 24 tightens the folded napkin 16 around the utensil set 20 to a rolled position, shown at 112. A tape feeder 26 provides a tape piece 28 from a tape stack or tape roll 30 to an outer surface of the napkin 16 that has been rolled around the utensil set 20 to secure the napkin 16 and utensil set 20 in a rolled-up position, and to complete the assembly of a service set 32, depicted at 114. The assembled service set 32 can then be provided to a basket or other type of service set holder.

Figure 2:
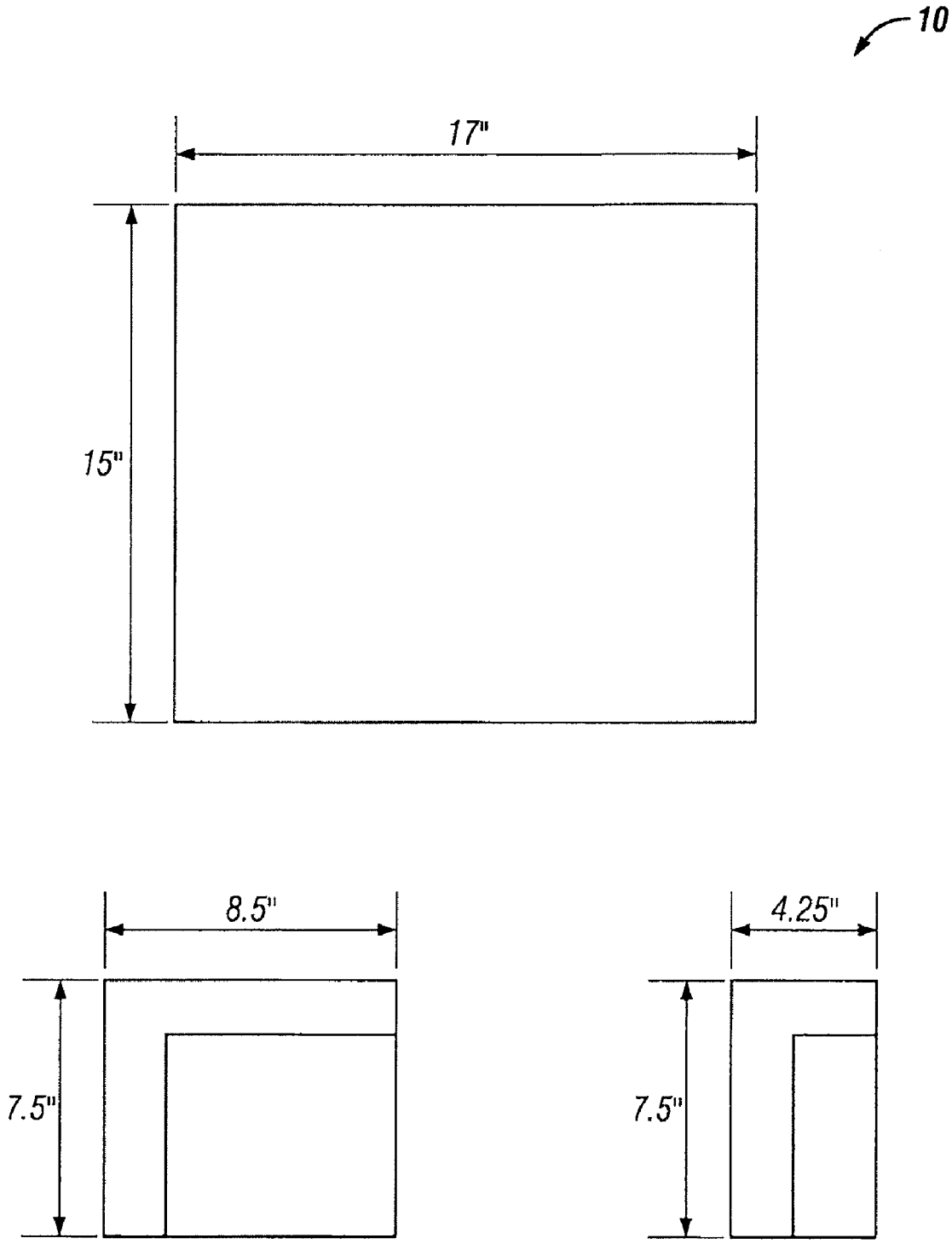
FIG. 2 illustrates a napkin and its various folds.
Figure 3:
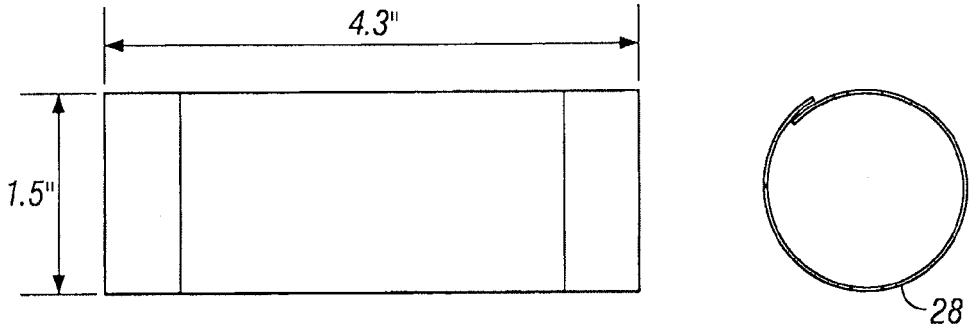
FIG. 3 illustrates a tap piece for securing a napkin around one or more utensils.

In one exemplary embodiment, the process for assembling a service pack utilizes a standard 15×17 inch napkin, however any size napkin 16 can be used, as shown in FIG. 2. The napkin 16 is preferably formed of paper, but linen or other cloth-like material napkin can also be used. As shown in FIG. 3, the tape piece 28 can include one or two adhesive end areas that are configured to adhere to each other. An adhesive can be provided on one or both adhesive end areas. In an embodiment, the adhesive end areas are provided on opposite sides of the tape piece 28, such that when the tape piece is rolled around the napkin 16 and utensil set 20, one adhesive end area is juxtaposed with, and at least partially overlaps, another adhesive end area.

In accordance with a specific embodiment, a service set includes the following: a napkin, such as those commonly available from restaurant supply houses, preferably in a "Quarter Fold" configuration, (unfolded, 15×17 inches); flatware or "Dinnerware Utensils", (knives and forks, and optionally spoons), which can be metallic or plastic, such as are commonly available from restaurant supply houses; a napkin band, which are also commonly available (in stacked format) from restaurant supply houses. In a specific embodiment, the napkin band is approximately 1.5×4.3 inches. The napkin bands are preferably paper strips with adhesive backing. The adhesive backing sticks to itself only and requires no treatment to activate the tackiness. The adhesive backing is a film applied to both sides of the strip but only at the (i.e.

approximately 1.5" wide) opposite ends and extending approximately one third of the length from the end, as shown above with respect to FIG. 3.

Figure 4:
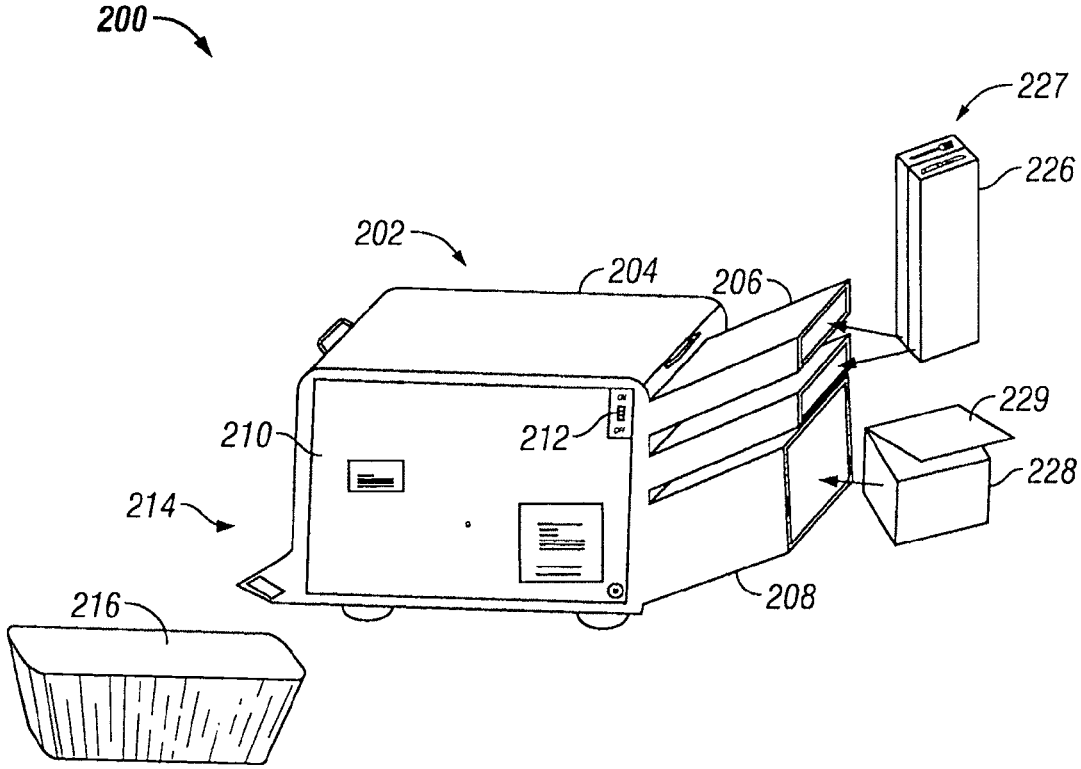
FIG. 4 is a perspective view of an apparatus for assembling a service set.

FIG. 4 shows a service set assembly system 200 in accordance with an exemplary embodiment. The system 200 includes an assembly device 202 configured to assemble and output a number of service sets, which includes utensils in a folded and/or rolled napkin contained by a tape piece or napkin band. The device 202 can use napkins, utensils and napkin bands typically found in restaurants, or napkins of unique dimensions, and a combination of common automation machine components such as pick-and-place assemblies, customized clamps, motorized linear and rotational bearings and slides, stepper motor and/or solenoid type actuators. An electronic control system 212 provides a control interface for activating the individual internal components of the device 202 in a particular sequence employed to assemble the service set.

This device 202 incorporates features that facilitate loading and installation of magazines, installation and removal of the receiver. The device 202 is easy to operate and includes safety features such as GFCI circuitry, an EPO switch and tamper-proof access panels for service. To increase reliability of the device, and to simplify manufacturing assembly and maintenance in the field, no hydraulics or pneumatics are employed with the preferred embodiment.

The device 202 includes a housing 204. The housing 204 is preferably squared or cubed, formed of rigid plastic or stainless steel, and may have a number of padded legs or feet on which the housing 204 is positioned upon a planar surface. The housing 204 includes one or more inlets 206 for receiving a cartridge 226 containing a number of utensils 228. For example, there may be two inlets 206, each for accepting individual cartridges 226 for forks and knives. A third inlet 206 may be provided to receive a cartridge 226 of spoons. The cartridges 226 provide the utensils 228 in a generally stacked configuration for serial placement to the device 202 one-at-a-time.

The housing 204 also includes a napkin inlet 208 that is sized and configured to receive a napkin cartridge 228 containing a stack of individual napkins 229. Alternatively, the stack of individual napkins 229 can be fed directly to the napkin inlet 208. The device 202 also includes an outlet 214 through which assembled service packs are sent to a basket 216 or other receiving mechanism.

Figure 5:
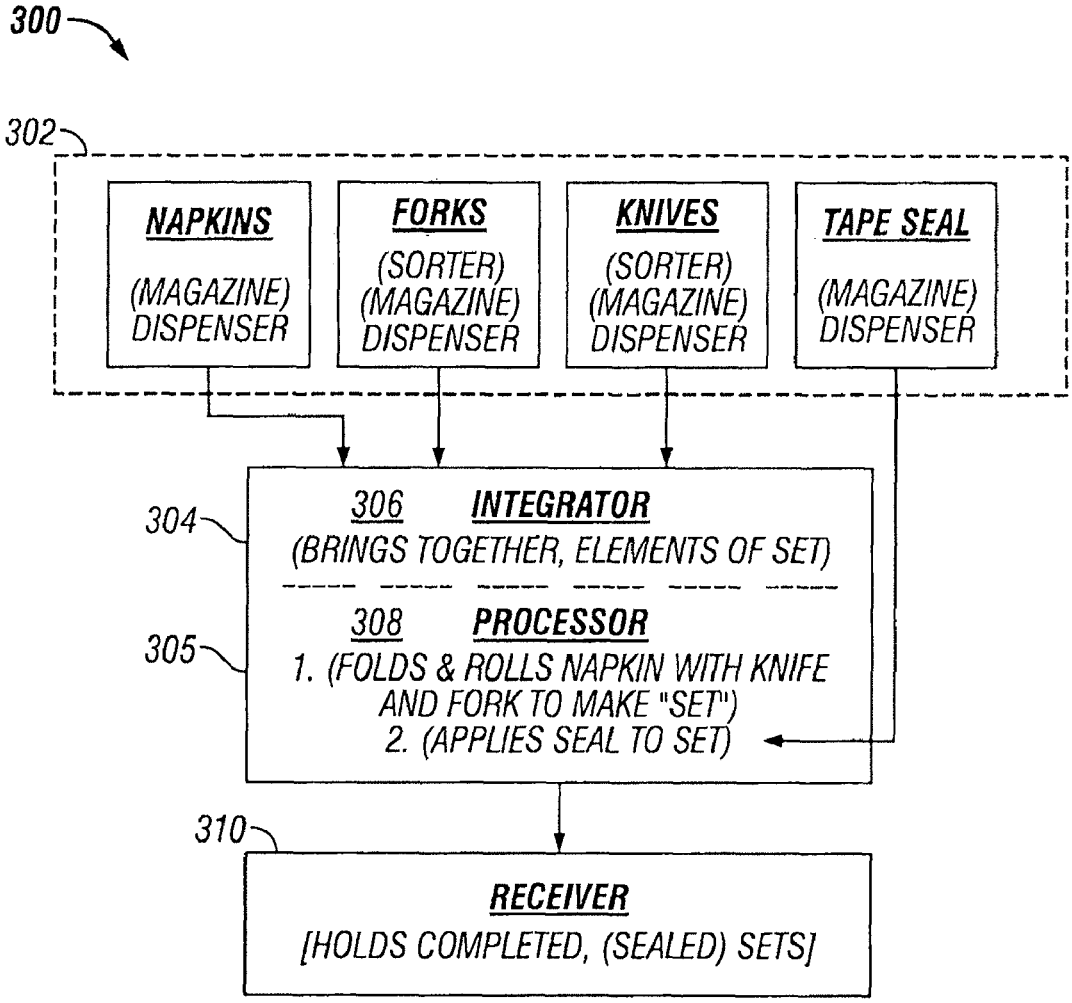
FIG. 5 is a block diagram of an apparatus.

In an alternative exemplary embodiment, a device 300 for assembling a service pack includes a number of sub-systems, as generally shown in FIG. 5. A magazine subsystem 302 includes one or more magazines for containing, sorting and/or dispensing the napkins, utensils and napkin bands. Each of these service pack components may be provided or dispensed in its own magazine, or a magazine may contain one or more items. An integrator subsystem 304 includes an integrator 306 that transfers the napkins and utensils from their magazines and positions them appropriately to a processor subsystem 305.

The processor subsystem 305 includes a processor 308 that folds and rolls a napkin to surround the utensils and then applies a napkin band to the napkin to form a service set. A receiver subsystem 310 includes a container that receives and holds the assembled, banded service set. These subsystems are described in further detail below. The receiver subsystem includes a basket-like container with a spring-loaded feature that facilitates a uniform filling of the container.

Figure 6:
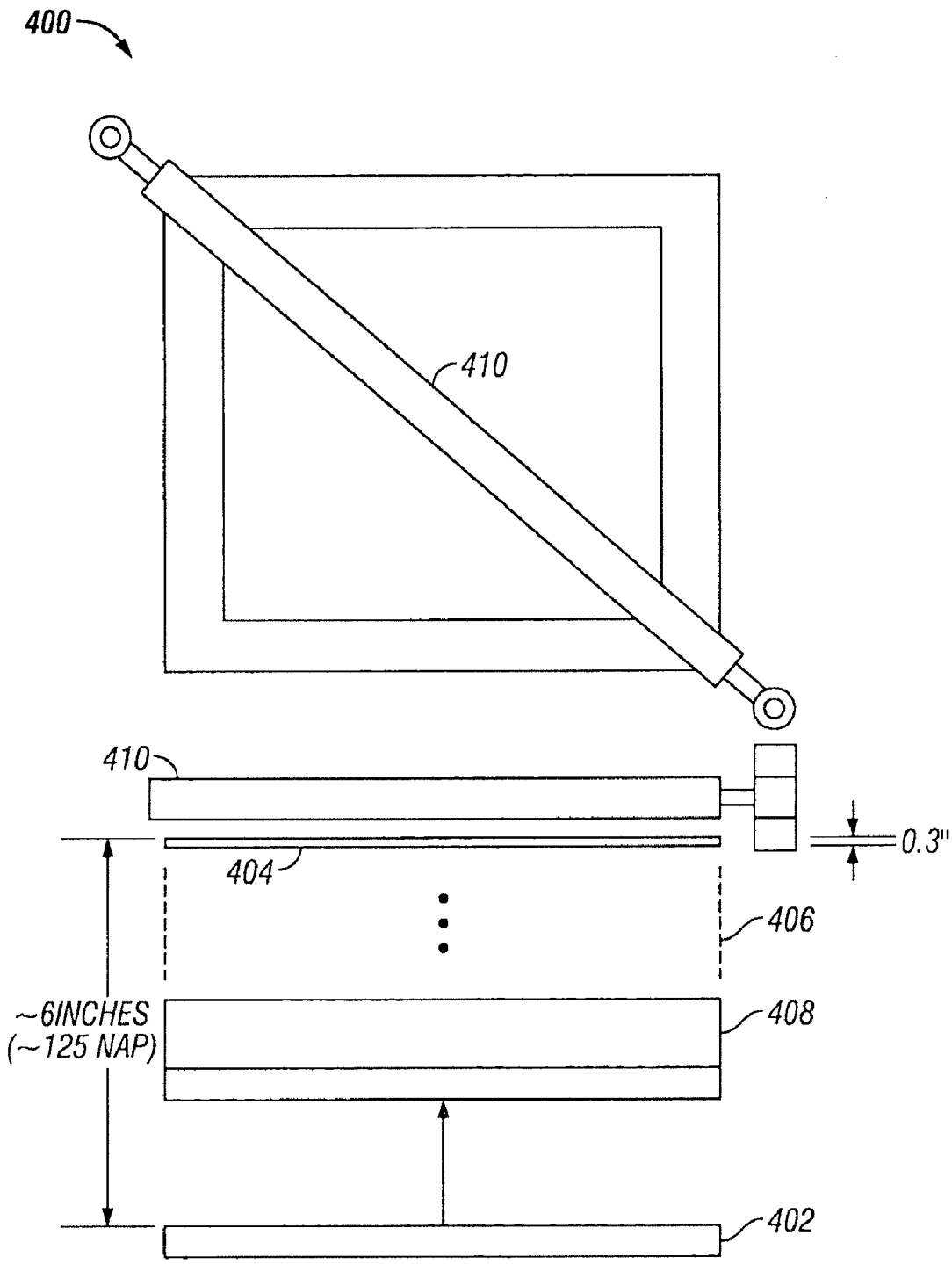
FIG. 6 is a plan view of a napkin magazine.

FIG. 6 is a plan view and side view of a napkin magazine 400. The napkin magazine 400 includes a spring-loaded plate 402 for supporting one or more napkins 404 in a napkin stack 406, and a foam pad 408 on the plate 402 to lift one or more corners of the last one or more napkins 404 in the napkin stack 406. The magazine 400 also includes a lift rod 410. The lift rod 410 lifts a selected number of napkins 404, i.e. one, from the napkin stack 406 for preparing the lifted napkin 404 for transfer to the integrator subsystem.

Figure 7:
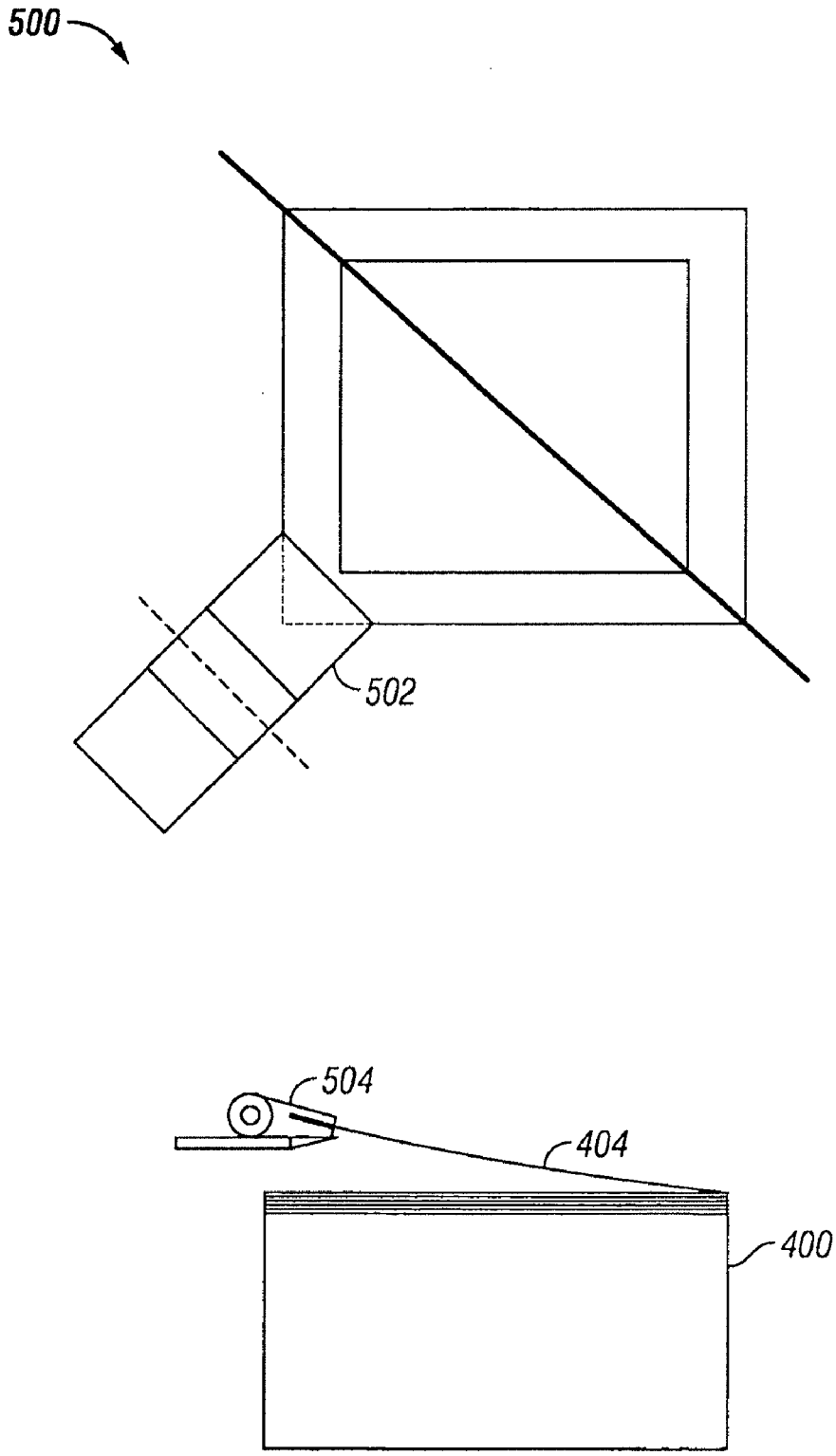
FIG. 7 includes plan and side views of a napkin magazine.

The integrator subsystem includes a napkin transfer assembly 500 that includes a clip and mechanism that picks a single napkin from its magazine and moves the napkin to a specific location in a particular orientation on the platen. FIG. 7 shows plan and side views of the napkin transfer assembly 500, in which an arm 502 is movable to the napkin magazine 400. The arm 502 includes a clip 504 that grasps a lifted corner of a napkin 404, and then moves the napkin 404 to the platen.

Figure 8:
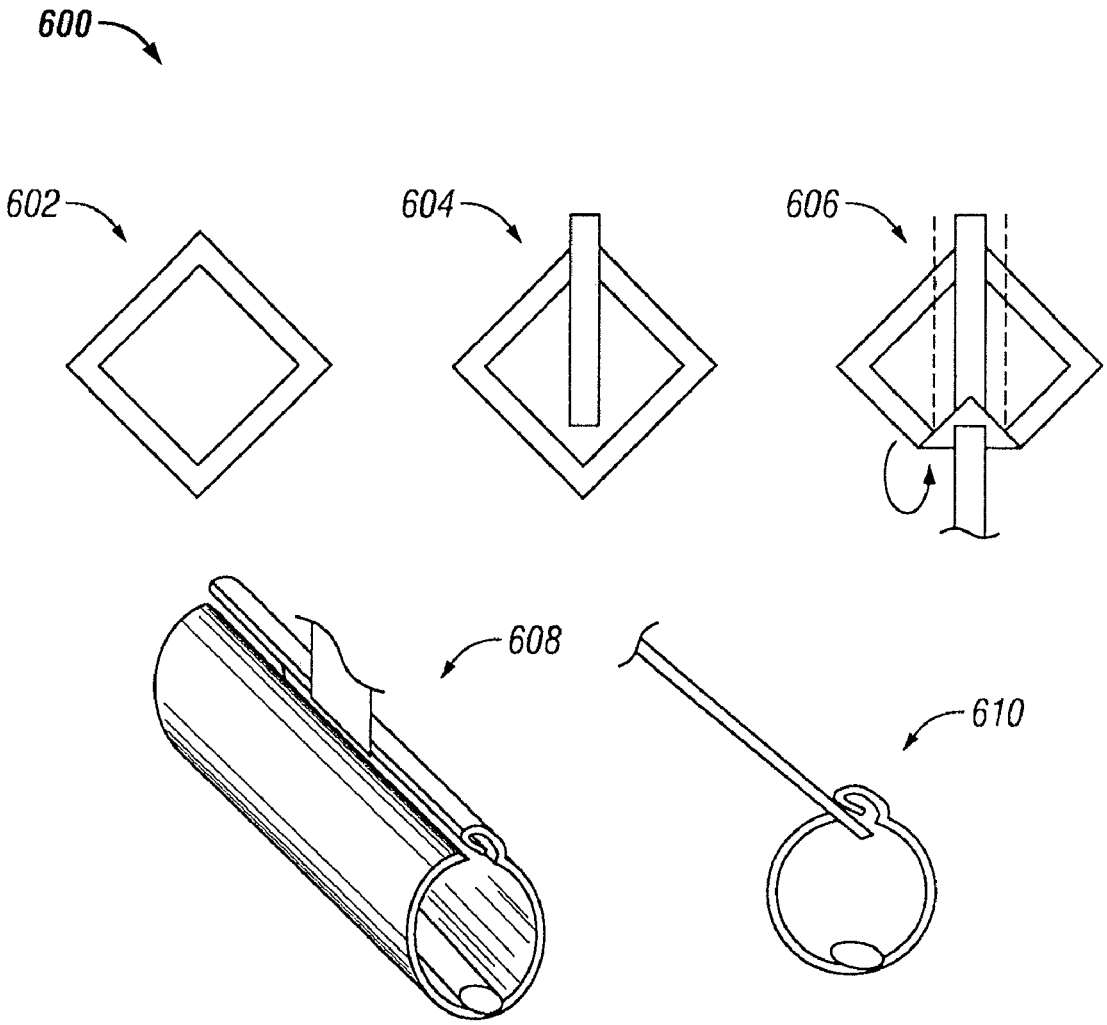
FIG. 8 illustrates a mechanical process for processing a napkin.

FIG. 8 graphically illustrates a process 600 by which a napkin is grabbed, positioned, folded, and rolled around set utensil to secure the utensil set inside the napkin. More particularly, the process 600 includes the following steps: transfer napkin from napkin magazine to platen (at 602); transfer fork from fork magazine to flatware clamp; transfer knife from knife magazine to flatware clamp; position loaded flatware clamp at napkin (604); move curler clamp to lift napkin corner into fold over handle ends of flatware (606); close curler clamp on folded napkin corner to capture flatware; release flatware clamp; move open roller jaws to surround flatware and napkin (608); close roller jaws to capture flatware in napkin; rotate closed roller jaws, as many full revolutions as are required to complete "roll-up" of napkin (610); move napkin band from napkin band magazine to roller jaw insertion point; rotate closed roller jaws to apply napkin band to assembled service set; open roller jaws; and dispense banded service set into receiver.

As described above, one or more utensils can be combined in a common magazine, be separated in a common magazine, or be separated in separate magazines and fed individually. Additionally, one magazine may be provided with multiple compartments for storing and providing all of the components of a service set. The above-described method need not necessarily be performed in the order or manner described, and can include variations on one or more of the steps.

Figure 9:
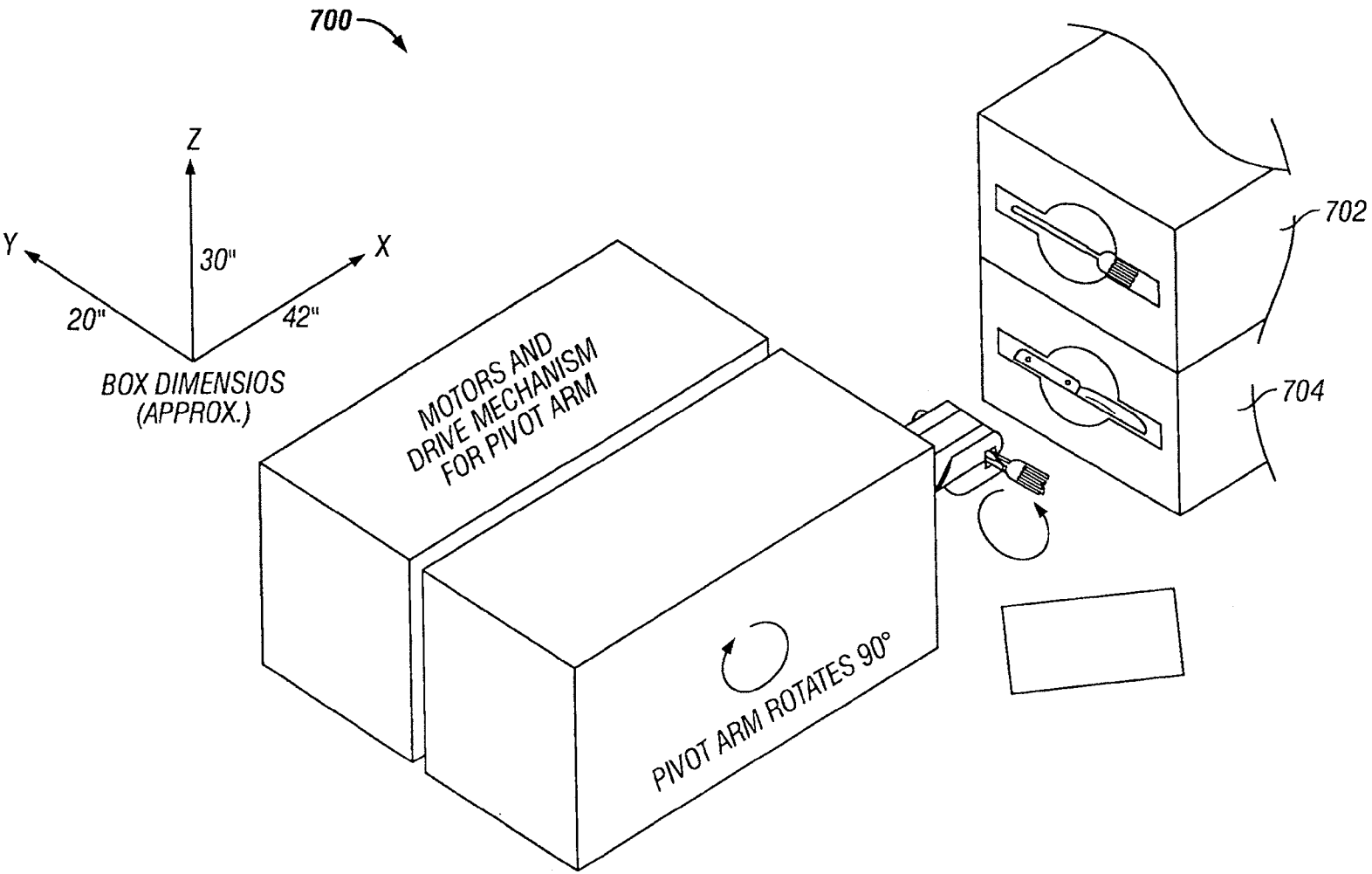
FIG. 9 is a perspective view of a portion of a service set assembly device.

FIG. 9 is a perspective view of a portion 700 of a service set assembly device, including a fork magazine 702 and a knife magazine 704. These magazines can include a coil or other structure that is rotated to convey the items to a dispensing point. In a rifle configuration, the cartridges are stacked in proximity to each other. In a bailing machine configuration, a row of utensils is lifted into the bailing mechanism by a moving belt which has protruding tines to engage and move the utensils. The magazines 702 and 704 are preferably compact, of simple construction, and allow one of a kind of utensil to be removed at a time. A napkin band magazine facilitates extraction of a single band from either a stack or roll format.

Figure 10:
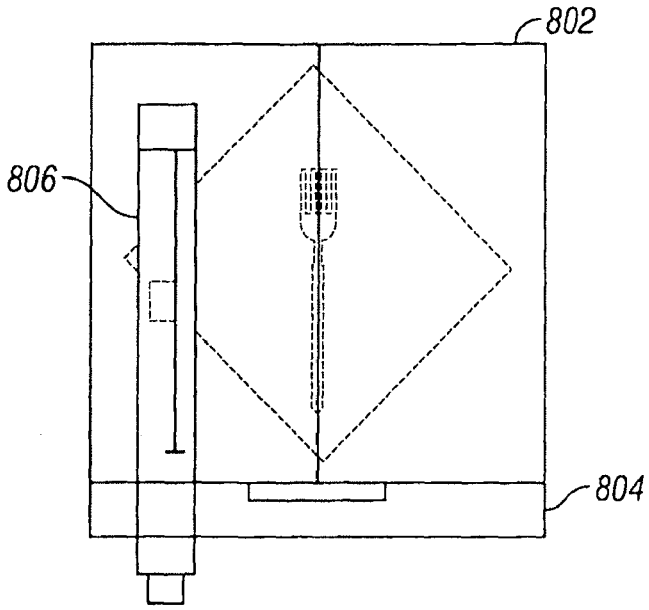
FIG. 10 is a plan view of a portion of a service set assembly device.

As illustrated in FIG. 10, the processor subsystem includes a platen 802. The platen is a two-part plate on which the napkin is positioned to facilitate the folding, rolling and banding processes. The processor subsystem further includes a curler clamp assembly 804. The curler clamp assembly 804 moves linearly to fold the napkin over the handle end of the utensil set, and closes to grasp the utensil set in the folded corner of the napkin. The curler clamp assembly 804 can be stationary while rolling and banding occurs.

A roller jaws assembly 806 surrounds the napkin and utensil set so as to facilitate the rolling of the napkin. The roller jaws assembly 806 is rotated to effect the rolling of the napkin. The roller jaws assembly 806 also introduces the napkin band to the napkin. The roller jaws assembly 806 is rotated again to effect the application of the band. When the service set has been banded, the roller jaws assembly is retracted. To dispense the banded service set into the receiver, one side of the platen may be tilted. This will allow the banded service set to be gravity-fed into a receiver.

Figure 11:
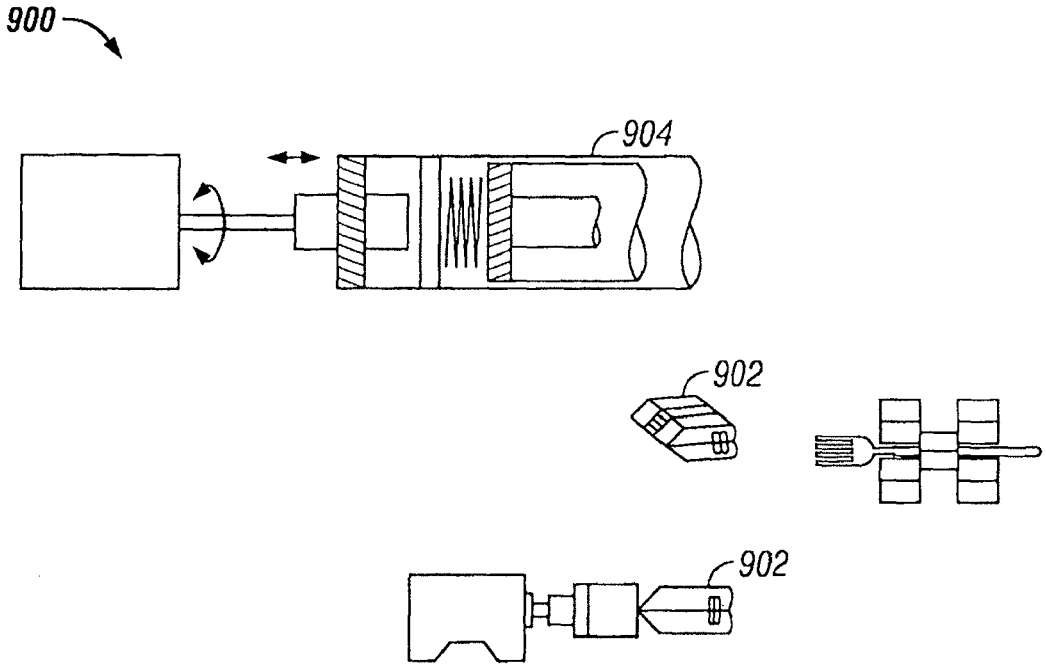
FIG. 11 shows a jaw clamp assembly for a service set assembly device.

FIG. 11 shows a flatware clamp assembly 900 that includes a clamp mechanism 902 that picks a single fork and knife from their respective magazines and moves them to a specific location on the napkin. The clamp mechanism is powered and controlled by a motorized linear motion mechanism 904, that opens a knife jaw while closing a fork jaw. Alternatively, the fork jaw can be sandwiched between two knife jaws, which are configured for alternative opening and closing. The position and orientation of the utensils to each other and to the napkin is provided by the path traveled by the flatware clamp assembly 900.

Figure 12:
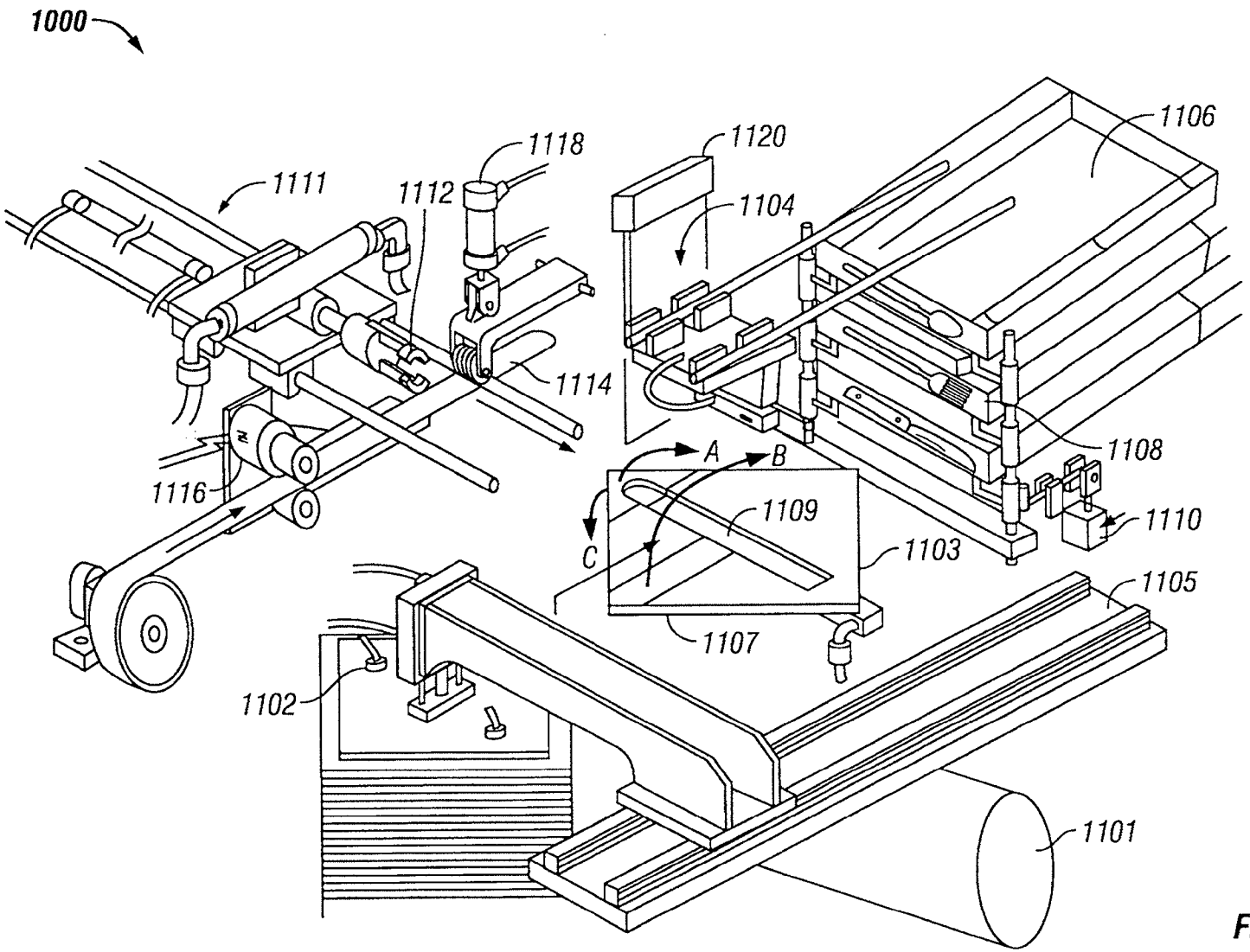
FIG. 12 shows a service pack assembly device in accordance with an alternative exemplary embodiment.

FIG. 12 shows an alternative embodiment of a device 1000 for assembling a service pack. The device 1000 includes a vacuum chuck 1102 powered by an air compressor and tank 1101. The vacuum chuck 1102 is configured to employ a vacuum force to a stack of napkins, which force will be adapted so that one napkin at a time is lifted from the stack of napkins. The vacuum chuck 1102 moves along a linear guide 1105 to place and orient the lifted napkin on folding stage 1103.

The device 1000 also includes a grabber 1104 that is positioned and movable to pick up one utensil from a utensil assembly 1106 that holds a number of utensils. The grabber 1104 may be adapted to pick up more than one utensil, such as one of each of a fork and knife, or a fork, knife and spoon. The grabber 1104 may pick up each utensil individually, or in a set. Each utensil picked up by grabber 1104 is positioned on the napkin on the folding stage 1103. The grabber 1104 can include a hand that includes a pneumatic cylinder to engage and disengage a pin or other type of mechanism, for grabbing the utensil.

The utensil assembly 1106 can include one or more cartridges holding utensils. The cartridges can be stacked. The utensil assembly 1106 also includes a sterilization system 1120 such as UV lights for sterilizing at least a utensil to be picked up by the grabber 1104 prior to positioning on the folding stage 1103. However, the sterilization system 1120 may be configured for sterilizing the utensils after they have been positioned on the folding stage 1103. The utensil assembly 1106 further includes a number of cylinders 1110 to push a utensil toward a position at which the grabber 1104 can engage the utensil.

The folding stage 1103 includes one or more leverage arms 1107 to fold the napkin over the utensils placed thereon. For example, a first leverage arm can fold a first corner over a lower end of the utensils, and a second leverage arm can fold the napkin from one side over to the opposite side of the utensils. The folding stage 1103 can include a channel 1109 that is sized for receiving the one or more utensils, to hold the utensils in place and assist in the folding process.

The device 1000 further includes a roller and banding assembly 1111, which includes a rotary grabber 1112 that is moved laterally toward the folded napkin and utensils to grab the napkin and utensil combination. The rotating grabber 1112 is moved by a rotating cylinder to rotate the grabbed napkin and utensil combination, and then retracted back to an original banding position above a napkin band strip 1114.

In the banding position, an electric motor 1116 or other mechanism drives the napkin band strip 1114 over the napkin/utensil combination. A roller 1118 activates to apply pressure to the band as the rotary grabber 1112 now rotates in an opposite direction to complete the banding operation. A portion of the napkin band strip is cut at a predetermined length, and the band is sealed around the napkin/utensil combination to create a service pack. The service pack is then dropped into a tray or forwarded to a service pack area for use.

Figure 13:
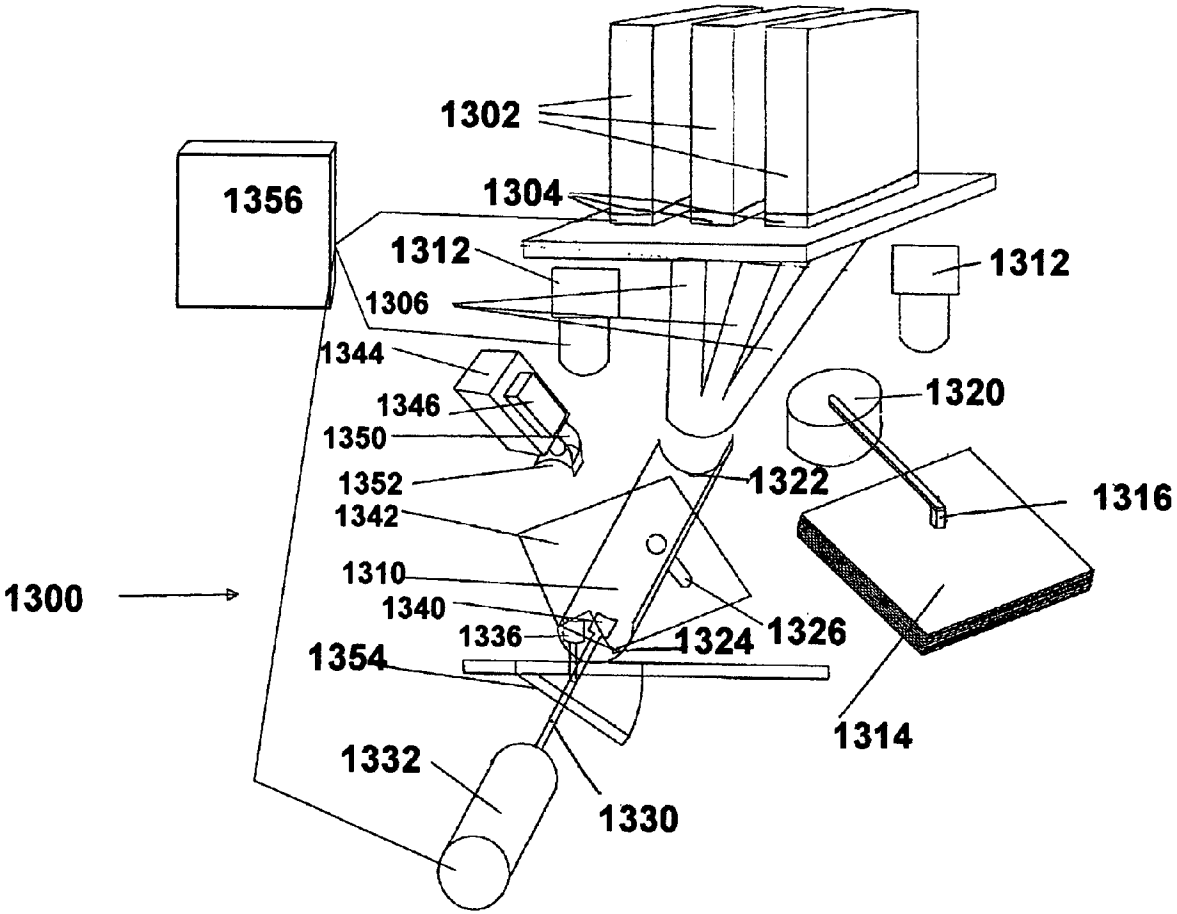
FIG. 13 is a schematic diagram showing a service set assembly system in accordance with another implementation.

In a further implementation, which is illustrated in FIG. 13, an apparatus includes one, two, three or more, utensil or silverware cartridges 1302. Each utensil cartridge 1302 holds pre-stacked utensils of one type that are arranged one on top of the other ready for release from a bottom side of the utensil cartridge 1302. Each utensil cartridge 1302 is positioned over or otherwise associated with a release mechanism 1304 that releases one utensil at a time on command. Positioned beneath each release mechanism 1304 is a utensil guide 1306 that steers the released utensil to a drop point on a receiving cradle 1310. One or more ultraviolet light sources 1312 are positioned to irradiate with ultraviolet light each released utensil as it is guided by its respective utensil guide 1306 to the receiving cradle 1310. In this manner, the utensils can be bathed in UV light to neutralize bacteria, viruses and any other pathogens that may be present. As a safety measure and to reduce heat and power drain the UV light sources 1312, which can be lamps or other comparable means of generating UV light of sufficient intensity to sterilize the utensils, can run at a reduced standby power level that is pulsed to high power during the transition of the released utensil or utensils past the UV light sources 1312.

A source of napkins 1314, such as for example a stack of napkins or a bundle retained in a bin or magazine is positioned sufficiently close to the receiving cradle to allow a vacuum chuck 1316 attached to a rotating or other movable napkin delivery apparatus 1320 to move and arrange one or more napkins within an inner surface of the receiving cradle 1310. The inner surface of the receiving cradle is generally curved upward to form a trough or other upwardly curved surface for receiving the released utensils from the utensil guides 1306. The receiving cradle 1310 has an entry end 1322 and an exit end 1324. The receiving cradle 1310 can generally be symmetrical about a central, vertical plane passing along a line between the entry end 1322 and the exit end 1324. Each of the utensil guides 1306 can have an inlet end positioned near the release mechanisms 1304 for the respective utensil cartridges 1302 and an outlet end positioned near and above the entry end 1322 of the receiving cradle 1310. In one example, the receiving cradle 1310 can be positioned at approximately a 45 degree angle relative to vertical. A vacuum port 1326 connected to a source of suction or at least partial vacuum is formed in the receiving cradle 1310 along the central axis of the receiving cradle 1310 and disposed between the entry end 1322 and the exit end 1324.

Positioned near the exit end 1324 of the receiving cradle 1310 is a service set assembly sub-mechanism that includes a rotating shaft 1330 connected to a drive motor 1332. Attached to a free end of the shaft 1330 are two small fingers opposed to each other and joined at a connection point 1334. In one implementation, a first finger 1336 is adjustable and a second finger 1340 is fixed such that it does not move relative to the shaft 1330. In idle position the fixed second finger 1340 rests upon the inner surface of the receiving cradle 1310 at the exit end 1324. A napkin 1342 placed by the napkin delivery apparatus 1320 and vacuum chuck 1316 onto the inner surface of the receiving cradle 1310 sits with a corner positioned over the end of the fixed second finger 1340. The first, movable finger is positioned in a raised position to lift the corner end of the napkin 1342 to form a barrier at the exit end of the receiving cradle 1310 upon which the released utensils impinge and come to rest in a properly aligned formation that is ready for wrapping in the napkin. Vacuum is applied via the vacuum port 1326 to hold the napkin 1342 in position within the receiving cradle 1310.

Once the desired complement of released utensils is received on the napkin 1340 held on the receiving cradle 1310 by vacuum form the vacuum port 1326, the first, movable finger 1336 is moved down to fold the raised corner of the napkin 1342 over the heads of the utensils. In this manner, the napkin utensil combination is grasped between the first, movable finger 1336 and the second, fixed finger 1340.

The rotating shaft 1330 is rotated to cause the napkin utensil package turn and the napkin 1342 to begin to roll about the utensils. The napkin utensil package is rotated at one end by the first and second fingers 1336, 1340. To stabilize the napkin utensil package and assist in wrapping the napkin about the utensils with suitable tension to create a tightly wrapped final product, a wrapping guide 1344 is lowered from above the receiving cradle 1310. The wrapping guide 1344 includes an adhesive band dispenser 1346 that dispenses an adhesive band 1350 and that can include an associated information printer. The wrapping guide 1344 includes a concave channel 1352 that is aligned with the receiving cradle 1310 such that when the receiving guide is lowered, the concave channel limits the final size of the wrap. The adhesive band 1350 is also positioned for application about the wrapped napkin utensil package. The adhesive band 1350 is applied, the motor shaft 1330 is retracted and the wrapping guide 1344 is raised at which point the operation is complete. A trap door 1354 or other delivery port is opened for the finished item to fall into a catch bin beneath the apparatus. The motor drive shaft 1330 is then returned to the starting position waiting for the next napkin 1342.

A processor 1356 can be included to provide programmable control of one or more functions of the apparatus. For example, the processor 1356 can be connected to and control one or more of the release mechanisms 1304, the ultraviolet light sources 1312, the vacuum chuck 1316 and napkin delivery mechanism 1320, delivery of suction to the vacuum port 1326 in the receiving cradle, the rotating shaft motor 1332, the first 1336 and second finger 1340, and the wrapping guide and adhesive band dispenser. A stacking mechanism can also be provided for feeding wrapped serve sets into one or more receiving baskets so that by moving a dispensing chute below the trap door 1354, service sets can be distributed within a collection basket in an ordered and even manner.

The current subject matter can in some implementations include a "print on demand" option in which specific text, graphics, or a combination thereof can be printed on the napkin bands 1350 prior to final assembly of the service sets. The printed information can include, but is not limited to product info, specials of the day, coupons, sponsor advertisings, and the like. The napkin bands 1350, which can be provided on a roll or in a stack, can enter the embedded printer unit 1346. The processor 1356 can communicate through the internal software to direct the printing of different information on one or both sides of the napkin bands 1350 before the bands are prepared to be wrapped around the wrapped service set. Software can be executed on the processor 1356 that communicates with the printer and also with a main control system in the facility, such as an external control system that could be a Point of Sales (POS) system through Ethernet and/or Wi-Fi or other internet connection sources. The main control software can have several functions, other than the main function of keeping the mechanical operations of the unit in synch and organized. In some implementations, the software can work as a counter to measure the number of silverware rollups being done, it can facilitate communication through the facility's control system, such as the POS system to be able to take advantage of advertising options and the print-on-demand functions in the back of the napkin bands. It can also analyze and determine the estimate costs of the rollups to the operator and offer a cost benefit analysis to them. The software can also include a user interface via which a user can manually adjust various functions of the apparatus, such as the number of each kind of utensil to include in each package, a logo or text to print on a napkin band, etc.

The software and processor 1356 can optionally also provide an Interactive (for example on a DVD or other video media) manual functionality to allow a user to easily learn the functions of the unit via a display screen or via remote access from a networked terminal and to quickly identify problems with the unit and to find the best solutions to solve the problem. Also, through the networked connectivity, such a via an intranet, the Internet, or some other computer to computer network, the software and processor can automatically send analyses of one or more diagnosed problem (Diagnostics Report) to an authorized service provider to handle such issues quickly and with a minimum down time. Service operators and technicians can also communicate with the unit through an IR sensor unit on the equipment to download and receive the diagnostics and other important data to their handhelds and PDAs.

The software can also enable operators to handle Inventory Control for the napkins and napkin bands by measuring the average number of rollups per day and keeping an accurate record of the inventory of the napkins and bands as they are being used in the unit. As inventory of any consumable in the process (i.e. utensils, napkins, bands, printer ink, etc.) begins to be reduced to near a threshold value, the software can automatically notify an operator to re-order supplies and they can either re-order the same and usual amount or to choose a different option and the software through the secure system, can send their orders to a vendor automatically for processing.

Figure 14:
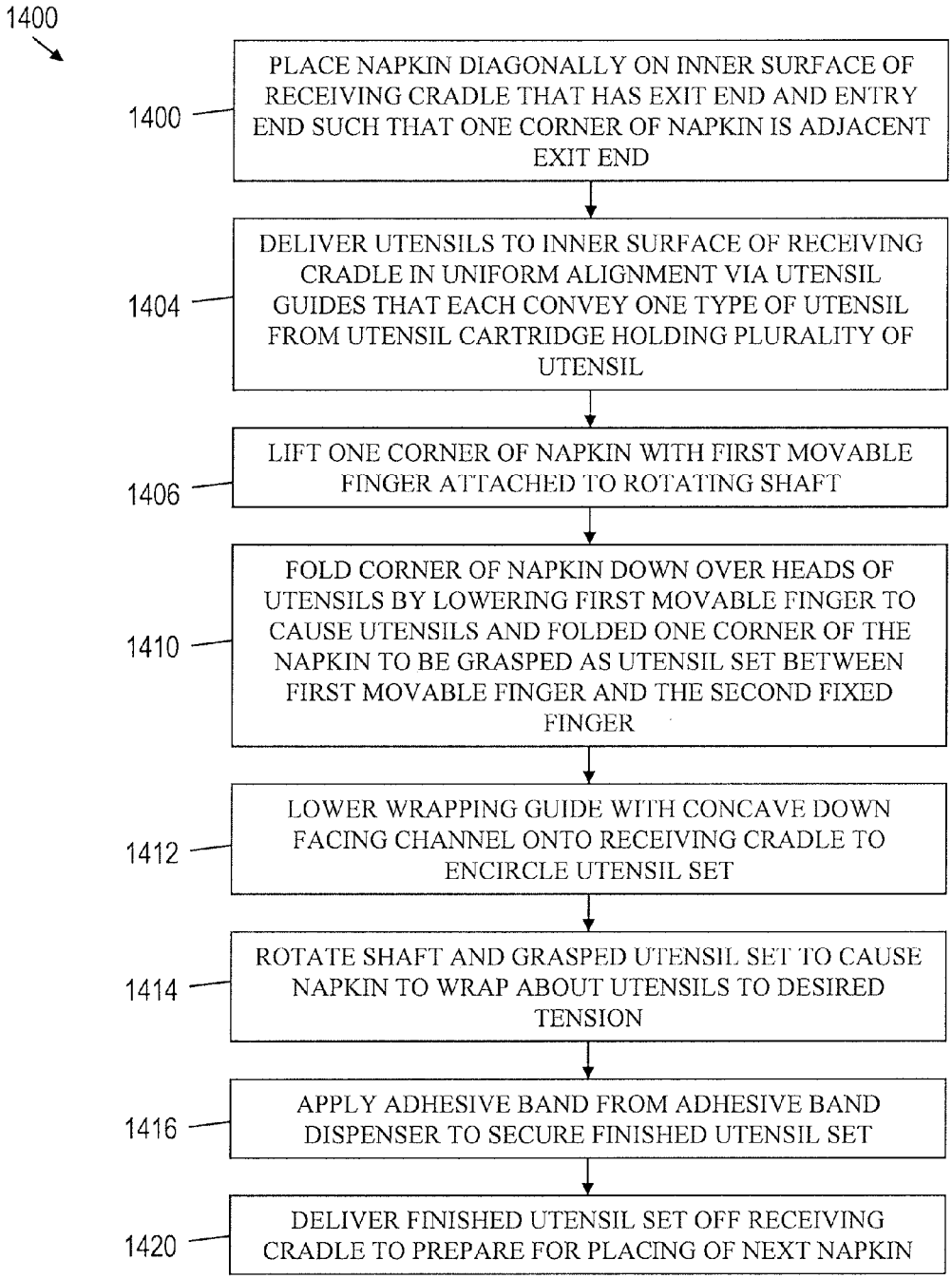
FIG. 14 is a process flow diagram showing a method for assembling a service set.

FIG. 14 shows a process flow chart 1400 illustrating a method for assembling a service set. At 1402 a napkin is placed diagonally on an inner surface of a receiving cradle having an exit end and an entry end. One corner of the napkin is located near the exit end. At 1404, utensils are delivered to the inner surface of the receiving cradle in a uniform alignment. Each utensil type is delivered by a dedicated utensil guide that receives one utensil at a time from utensil cartridges such as is described above. The uniform alignment can be that all of the utensils have their heads (such as for example the tines of a fork, bowl of a spoon, and blade of a knife) directed downward so that the head leads the utensil into the receiving cradle. At 1406, one corner of the napkin is lifted by a first movable finger that is attached to a rotating shaft. The rotating shaft can also include a second fixed finger that extends under the corner of the napkin. The first movable finger and the lifted one corner of the napkin can provide a stop against which the delivered one or more utensils come to rest in the uniform alignment, for example with all of the utensil heads positioned closest to the raised corner of the napkin. At 1410, the movable finger lowers to fold the corner of the napkin down over the utensils heads. This process causes the utensils and the folded over napkin to be grasped between the movable finger and the second fixed finger.

At 1412, a wrapping guide that has a concave down facing channel is lowered to near the inner surface of the receiving cradle to encircle the utensil set that includes the napkin and the utensils. At 1414, the shaft rotates, thereby causing the utensil set grasped by re first movable and the second fixed fingers to also rotate and the napkin to become wrapped about the utensils to a desired tension. At 1416, an adhesive band can be applied from an adhesive band dispenser. Finally, at 1420 the finished utensil set can be delivered off of the receiving cradle, such as for example through a trap door to a basket positioned below the receiving cradle.

The subject matter described herein may be embodied in systems, apparatus, methods, and/or articles depending on the desired configuration. In particular, various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications, applications, components, or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the subject matter described herein may be implemented on or in conjunction with one or more computers or input terminals having a display device (e.g., a CRT (cathode ray tube) or LCD (liquid crystal display) monitor) for displaying information to the user and a keyboard and a pointing device (e.g., a mouse or a trackball) by which the user may provide input to the computer. Other kinds of devices may be used to provide for interaction with a user as well; for example, feedback provided to the user may be any form of sensory feedback (e.g., visual feedback, auditory feedback, or tactile feedback); and input from the user may be received in any form, including acoustic, speech, or tactile input.

Although a few variations have been described in detail above, other modifications or additions are possible and are within the scope of this disclosure. In particular, further features and/or variations may be provided in addition to those set forth herein. For example, the implementations described above may be directed to various combinations and subcombinations of the disclosed features and/or combinations and subcombinations of several further features disclosed above. One or more features, aspects, functions, and the like of the various implementations and embodiments disclosed herein can be used in any functional combination, and the scope of the disclosed subject matter is intended to encompass any such combination or subcombination of such elements and features.

The one or more utensils can optionally include a spoon. The napkin may be paper-based or linen-based. The utensils may be plastic-based or metal-based. The device may be adapted for high-throughput and/or high volume for large-scale operations. Devices may optionally be adapted to allow more complex or elaborate napkin folding or design arrangements and/or to apply a logo to the napkin and/or napkin band/tape piece. In addition, the logic flow depicted in the accompanying figures and/or described herein do not require the particular order shown, or sequential order, to achieve desirable results. Other embodiments may be within the scope of the following claims.

What is claimed is:

1. A method comprising:

placing a napkin on an inner surface of a receiving cradle, the receiving cradle having an exit end and an entry end, the napkin being placed diagonally onto the receiving cradle such that one corner of the napkin is adjacent the exit end, the inner surface having an upward facing concave shape;

delivering one or more utensils to the inner surface of the receiving cradle via one or more utensil guides, each of the one or more utensil guides conveying one type of utensil from a utensil cartridge that holds a plurality of that one type of utensil in an ordered manner such that each released utensil is released onto the utensil guide in a uniform alignment and then delivered to the receiving cradle with the same uniform alignment;

lifting the one corner of the napkin with a first movable finger attached to a rotating shaft, the rotating shaft also comprising a second fixed finger that extends under the corner of the napkin, the first movable finger and the lifted one corner of the napkin providing a stop against which the delivered one or more utensils come to rest in the uniform alignment;

folding the one corner down over the heads of the one or more utensils by lowering the first movable finger, the lowering of the first movable finger causing the one or more utensils and the folded one corner of the napkin to be grasped as a utensil set between the first movable finger and the second fixed finger;

lowering a wrapping guide having a concave down facing channel onto the receiving cradle such that the utensil set is encircled by the concave down facing channel of the wrapping guide and the concave up inner surface of the receiving cradle; and rotating the shaft and the grasped utensil set to cause the napkin to be wrapped about the one or more utensils to a desired tension.

2. A method in accordance with claim 1, further comprising delivering the finished utensil set off the receiving cradle to prepare for placing of a next napkin.

3. A method in accordance with claim 1, further comprising applying an adhesive band from an adhesive band dispenser to secure a finished utensil set.

4. A method in accordance with claim 3, wherein the adhesive band dispenser is attached to the wrapping guide.

5. A method as in claim 3, further comprising printing content on the adhesive band via a printer, the printing being controlled by a processor that provides "on demand" control of the content.

6. A method as in claim 5, further comprising communicating with an external control system via a computer network to receive the content for printing on the adhesive band.

7. A method in accordance with claim 1, further comprising sterilizing the one or more utensils as the one or more utensils are conveyed via the one or more utensil guides, the sterilizing comprising irradiating the one or more utensils with ultraviolet light from one or more ultraviolet light sources positioned to direct the ultraviolet light onto the utensil guides.

8. A method as in claim 1, further comprising monitoring a supply of napkins and/or utensils via a processor; and generating and promoting a request for replenishment if the supply is below a preset threshold.

9. A method as in claim 1, further comprising holding the napkin in place on the receiving cradle using suction from a port in the receiving cradle.

10. A method as in claim 1, wherein the uniform alignment comprises a head of all of the utensils being positioned closest to the exit end of the receiving cradle and against the one corner of the napkin and the first movable finger.

11. A method as in claim 1, wherein the uniform alignment comprises a handle of all of the utensils being positioned closest to the exit end of the receiving cradle and against the one corner of the napkin and the first movable finger.

12. An apparatus comprising:

a utensil cartridge adapted to hold a plurality of one type of utensil;

a release mechanism that releases one utensil at a time from the utensil cartridge;

a utensil guide having an inlet end and an outlet end, the inlet end being associated with and disposed below the release mechanism to receive the released utensil from the utensil cartridge; the utensil guide being disposed at a downward angle such that gravity causes the released utensil to travel from the inlet end to the outlet end, the released utensil entering the utensil guide in a specific and predetermined orientation;

a receiving cradle aligned at a downward angle between an entry end and an exit end, the entry end disposed at a higher point than the exit, the entry end positioned to receive the released utensil from the outlet end of the utensil guide onto a upward facing concave inner surface of the receiving cradle, the inner surface being substantially symmetrical about a central vertical plane passing between the outlet end and the inlet end;

a napkin handler that moves a napkin from a napkin supply point to the receiving cradle prior to delivery of the utensil from the utensil guide, the napkin being placed with one corner near the exit end;

a wrapping guide having a concave down facing channel that lowers onto the receiving cradle such a utensil set comprising the napkin and the released utensil is encircled by the concave down facing channel of the wrapping guide and the upward facing concave inner surface of the receiving cradle;

a rotating mechanism comprising a first finger and a second finger, the first finger and the second finger originating from a common pivot point positioned on a rotating shaft having an axis of rotation, the first finger being movable about the pivot point, the second finger being fixed at the pivot point to remain substantially aligned with the axis of rotation, the first movable finger lifting the one corner of the napkin to provide a stop against which the released utensil comes to rest in a uniform alignment, the first movable finger folding the one corner down over the utensil and causing the utensil and the folded one corner of the napkin to be grasped as a utensil set between the first movable finger and the second fixed finger, the shaft rotating about its axis and causing the napkin to wrap about the grasped utensil set to a desired tension while the wrapping guide steadies the utensil set in the receiving cradle; and an adhesive band dispenser that dispenses an adhesive band dispenser that is secured about a finished utensil set.

13. An apparatus as in claim 12, further comprising an ultraviolet light source positioned to irradiate the released utensil with ultraviolet light as the released utensil passes between the inlet end and the outlet end of the utensil guide, the ultraviolet light at least partially sterilizing the released utensil.

14. An apparatus as in claim 12, wherein the adhesive band dispenser is attached to the wrapping guide.

15. An apparatus as in claim 12, further comprising a processor that directs functions of one or more of the release mechanism, the rotating shaft, the napkin delivery mechanism, the wrapping guide, and adhesive band dispenser.

16. An apparatus as in claim 15, wherein the processor receives monitoring data that characterizes a supply of napkins and/or utensils and generates and promotes a request for replenishment if the supply is below a preset threshold.

17. An apparatus as in claim 15, further comprising a printer for printing content on the adhesive band, the printing being controlled by the processor to provides "on demand" control of the content.

18. An apparatus as in claim 17, wherein the processor communicates with an external control system via a computer network to receive the content for printing on the adhesive band.

19. An apparatus as in claim 12, further comprising one or more additional utensil cartridges, one or more additional release mechanisms, and one or more additional utensil guides that provide one or more additional utensils to the utensil set assembled on the receiving cradle, the one or more additional utensils being delivered in the uniform alignment.

20. An apparatus as in claim 12, wherein the inner surface of the receiving cradle comprises a vacuum port formed therein and disposed between the entry end and the exit end and aligned with the central vertical plane, the vacuum port being connected to a source of at least partial vacuum for holding the napkin in place.

* * * * *